US010533235B2

(12) United States Patent
Fukumaru

(10) Patent No.: US 10,533,235 B2
(45) **Date of Patent: *Jan. 14, 2020**

(54) HOT-WORKING TOOL MATERIAL, METHOD FOR MANUFACTURING HOT-WORKING TOOL, AND HOT-WORKING TOOL

(71) Applicant: HITACHI METALS, LTD., Tokyo (JP)

(72) Inventor: Taishiroh Fukumaru, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 348 days.

This patent is subject to a terminal disclaimer.

(21) Appl. No.: 15/327,049

(22) PCT Filed: May 8, 2015

(86) PCT No.: PCT/JP2015/063318

§ 371 (c)(1),
(2) Date: Jan. 18, 2017

(87) PCT Pub. No.: WO2016/013273

PCT Pub. Date: Jan. 28, 2016

(65) Prior Publication Data

US 2017/0166987 A1 Jun. 15, 2017

(30) Foreign Application Priority Data

Jul. 23, 2014 (JP) ..... 2014-149487

(51) Int. Cl.
*C21D 1/18* (2006.01)
*C21D 6/00* (2006.01)
(Continued)

(52) U.S. Cl.
CPC ..... *C21D 9/0068* (2013.01); *C21D 1/18* (2013.01); *C21D 6/002* (2013.01); *C21D 6/005* (2013.01);
(Continued)

(58) Field of Classification Search
None
See application file for complete search history.

(56) References Cited

U.S. PATENT DOCUMENTS

2009/0188589 A1* 7/2009 Okitsu ..... C21D 6/005 148/504
2010/0193089 A1 8/2010 Kataoka et al.
(Continued)

FOREIGN PATENT DOCUMENTS

CN 103352108 A 10/2013
CN 103403209 A 11/2013
(Continued)

OTHER PUBLICATIONS

Translation of JP 09-316595 (published Dec. 9, 1997) J-Plat Pat.*
(Continued)

*Primary Examiner* — Colin W. Slifka
(74) *Attorney, Agent, or Firm* — Sughrue Mion, PLLC

(57) ABSTRACT

A hot-working tool material has an annealed structure and is to be quenched and tempered before using, wherein: the hot-working tool material has a composition from which a martensite structure can be prepared by the quenching; and, in ferrite crystal grains in the annealed structure in a cross section of the hot-working tool material, the ratio by number of ferrite crystal grains having a largest diameter (L) of 100 μm or more is not more than 10.0% relative to the total ferrite crystal grains, and the ratio by number of ferrite crystal grains having an aspect ratio (L/T) [wherein (L) stands for a largest diameter, and (T) stands for the largest transverse width orthogonally crossing the same] of 3.0 or more is not more than 10.0% relative to the total ferrite crystal grains.

5 Claims, 3 Drawing Sheets

OPTICAL PHOTOMICROGRAPH

100 μm

GRAIN BOUNDARY VIEW

(51) Int. Cl.

| | |
|---|---|
| ***C21D 9/00*** | (2006.01) |
| ***C22C 38/00*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |

(52) U.S. Cl.
CPC ..... *C21D 6/008* (2013.01); *C22C 38/002* (2013.01); *C22C 38/02* (2013.01); *C22C 38/04* (2013.01); *C22C 38/22* (2013.01); *C22C 38/24* (2013.01); *C21D 2211/005* (2013.01); *C21D 2211/008* (2013.01)

(56) References Cited

U.S. PATENT DOCUMENTS

| | | | | |
|---|---|---|---|---|
| 2015/0041029 | A1* | 2/2015 | Yamashita ..... | C21D 8/06 148/645 |
| 2016/0348202 | A1* | 12/2016 | Nakano ..... | C21D 1/18 |

FOREIGN PATENT DOCUMENTS

| | | | |
|---|---|---|---|
| EP | 2 270 246 | A1 | 1/2011 |
| GB | 2 065 700 | A | 7/1981 |
| JP | 63-83249 | A | 4/1988 |
| JP | 02-179848 | A | 7/1990 |
| JP | 2000-42606 | A | 2/2000 |
| JP | 2000-328196 | A | 11/2000 |
| JP | 2001-294935 | A | 10/2001 |
| JP | 2002-248508 | A | 9/2002 |
| JP | 2005-336553 | A | 12/2005 |
| JP | 2006-104519 | A | 4/2006 |
| JP | 2007-56289 | A | 3/2007 |
| JP | 2007-297703 | A | 11/2007 |
| JP | 2009-215656 | A | 9/2009 |
| WO | 2008/032816 | A1 | 3/2008 |

OTHER PUBLICATIONS

Transation of JP 11-036044 (published Feb. 9, 1999) from J-Plat Pat.*

Translation of JP 2000-042606 (published Feb. 15, 2000) from J-Plat Pat.*

Communication dated Jul. 5, 2018 from the Korean Intellectual Property Office in counterpart application No. 10-2017-7001530.

Communication dated Dec. 4, 2017 issued by the European Patent Office in counterpart application No. 15824454.1.

International Search Report of PCT/JP2015/063318 dated Jun. 16, 2015.

* cited by examiner

OPTICAL PHOTOMICROGRAPH

100 μm

GRAIN BOUNDARY VIEW

OPTICAL PHOTOMICROGRAPH

100 μm

GRAIN BOUNDARY VIEW

OPTICAL PHOTOMICROGRAPH

100 μm

GRAIN BOUNDARY VIEW

OPTICAL PHOTOMICROGRAPH

100 μm

GRAIN BOUNDARY VIEW

HOT-WORKING TOOL MATERIAL, METHOD FOR MANUFACTURING HOT-WORKING TOOL, AND HOT-WORKING TOOL

CROSS REFERENCE TO RELATED APPLICATIONS

This application is a National Stage of International Application No. PCT/JP2015/063318 filed May 8, 2015 (claiming priority based on Japanese Patent Application No. 2014-149487 filed Jul. 23, 2014), the contents of which are incorporated herein by reference in their entirety.

TECHNICAL FIELD

The present invention relates to a hot work tool material suitable for a variety of hot work tools such as a press die, a forging die, a die-casting die, or an extrusion tool. The present invention also relates to a method of manufacturing the hot work tool from the material, as well as the hot work tool.

BACKGROUND ART

A hot work tool is required to have sufficient toughness to resistant to impact since the tool is used in contact with high-temperature or hard workpieces. Conventionally, alloy tool steel, such as SKD61 of JIS steel grade, has been used for a hot work tool material. Recently, further improved toughness has been required and thus an alloy tool steel having modified composition of the SKD61 alloy tool steel has been proposed (see Patent Literatures 1 to 3).

A material for the hot work tool is typically manufactured from a raw material steel piece, as a starting material, such as of a steel ingot or a bloom which is bloomed from the steel ingot. The starting material is subjected to various hot working and heat treatment to produce a predetermined steel material, and the steel material is finished by annealing. A hot work tool material in the annealed condition having a low hardness is typically supplied to a manufacturer of the hot work tool. The supplied material is machined into a shape of the hot work tool and then quenched and tempered to adjust its hardness for use. After the adjustment of the hardness, finishing machining is typically conducted. In some cases, quenching and tempering are conducted first for the material in the annealed condition, and then the machining is conducted for the shaping of the tool together with the finishing machining. Here, the term "quenching" refers to an operation where a hot work tool material (or a hot work tool material that has been subjected to machining) is heated to an austenitic phase temperature range and then rapidly cooled to transform it into a martensitic structure. Thus, the hot work tool material has such a composition that can have a martensitic structure by the quenching.

In this connection, it has been known that a toughness of the hot work tool can be improved by properly controlling an annealed structure prior to quenching and tempering of the hot work tool material. For example, proposed is a hot work tool material having an annealed structure including uniformly dispersed carbides therein, since precipitation of acicular carbides along a coarse bainite grain boundaries is suppressed by annealing the steel material in which precipitation of coarse bainite is suppressed (see Patent Literature 4). A hot work tool material having excellent toughness can be obtained when the material including uniformly dispersed carbides is quenched and tempered.

CITATION LIST

Patent Literatures

PATENT LITERATURE 1: JP-A-2-179848
PATENT LITERATURE 2: JP-A-2000-328196
PATENT LITERATURE 3: WO 2008/032816
PATENT LITERATURE 4: JP-A-2001-294935

SUMMARY OF INVENTION

Technical Problem

When the hot work tool material of Patent Literature 4 is quenched and tempered, a Charpy impact value of the hot work tool can be improved. However, even when the hot work tool has a high Charpy impact value as a whole, some portions in the tool have a higher or lower Charpy impact value than a target value in some cases due to "variation" of the Charpy impact value. Such a difference of the Charpy impact value may generate in the hot work tool in a position where toughness is particularly required, it considerably affects a lifetime of the hot work tool.

It is an object of the present invention to provide a hot work tool material having an annealed structure, which is effective in suppressing variation of toughness when the material is processed to a hot work tool, as well as providing a method of manufacturing the hot work tool using the hot work tool material, and the hot work tool.

Solution to Problem

The present invention relates to a hot work tool material having an annealed structure. to be quenched and tempered before use. The hot work tool material has such a composition that the material has a martensitic structure by quenching. The annealed structure in a cross-section of the hot work tool material comprising ferrite grains, wherein a ratio by number of ferrite grains having a maximum diameter L of not smaller than 100 μm is not more than 10.0% relative to a total number of the ferrite grains, and wherein a ratio by number of ferrite grains having an aspect ratio L/T of not less than 3.0 is not more than 10.0% relative to the total number of the ferrite grains Preferably, the ferrite grains in the annealed structure of the cross-section of the hot work tool material have an average grain size of not greater than 25.0 μm in equivalent circular diameter.

The present invention also relates to a method for manufacturing a hot work tool, including quenching and tempering the above hot work tool material.

The present invention also relates to a hot work tool having a cross-sectional structure including a martensite structure. An area ratio of prior austenite grains having a grain size number in accordance with JIS-G-0551 different by three or more from a most frequent grain size number of the prior austenite grains is not greater than 5 area %. Preferably, each two fields of view of the tool do not have the prior austenite grain size numbers in accordance with JIS-G-0551 different from each other by three or more.

Advantageous Effects of Invention

According to the present invention, variation of toughness of a hot work tool can be suppressed.

DESCRIPTION OF EMBODIMENTS

Figure 1A:
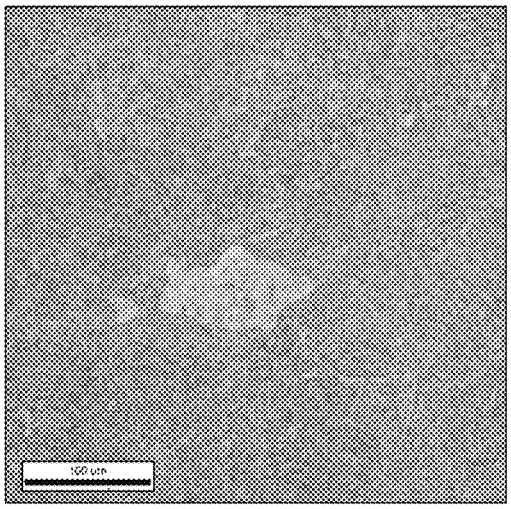
FIGS. 1A and 1B show examples of an optical photomicrograph FIG. 1A and a boundary view FIG. 1B obtained by electron backscatter diffraction (hereinafter referred to as "EBSD") of a cross-sectional structure of a hot work tool material D according to an inventive example.
Figure 1B:
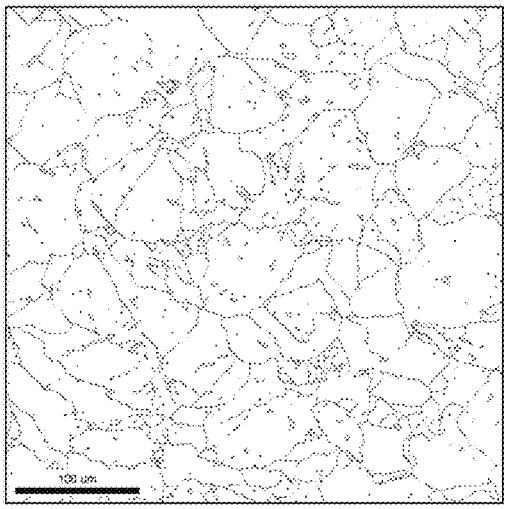
Figure 2A:
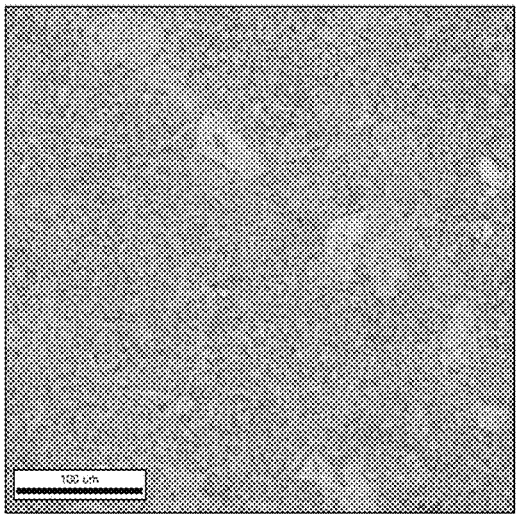
FIGS. 2A and 2B show examples of an optical photomicrograph FIG. 2A and a boundary view FIG. 2B obtained by EBSD of a cross-sectional structure of a hot work tool material E according to an inventive example.
Figure 2B:
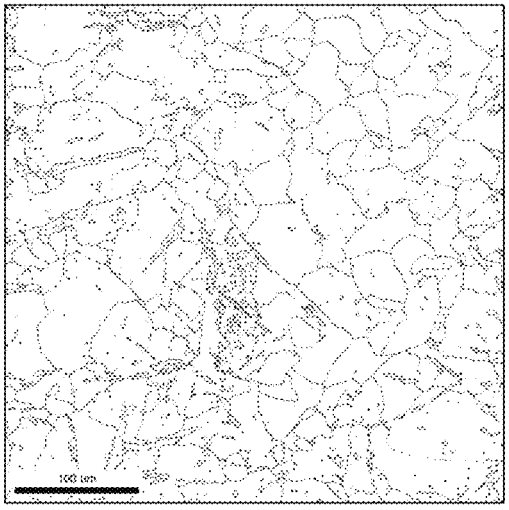

The inventor has studied what factors in an annealed structure of a hot work tool material have an effect on variation of toughness of a hot work tool. As a result, he has found that the factors involve a distribution of ferrite grains in the annealed structure. He has found that the variation of toughness after quenching and tempering can be suppressed by adjusting the distribution of the ferrite grains in the annealed structure to a predetermined distribution, and he reached the present invention. Constitutions of the present invention are described below.

(1) A hot work tool material having an annealed structure, the hot work tool material being to be quenched and tempered before use, the hot work tool material having such a composition that the material has a martensitic structure by quenching, The "annealed structure" is defined as a structure obtained by an annealing process. Typically, the structure is composed of a ferrite phase, or composed of the ferrite phase with pearlite or cementite ($Fe_3C$). The ferrite phase constitutes the "ferrite grains" in the annealed structure. In a case of a hot work tool material such as an alloy tool steel SKD61, carbides of Cr, Mo, W or V etc. may precipitate within the ferrite grains or at grain boundaries. In the present invention, the annealed structure preferably includes less pearlite or cementite. The pearlite or cementite may reduce machinability of the hot work tool material not a little.

It is difficult to adjust the annealed structure to have the ferrite phase, but bainite or martensite tends to be formed, due to significantly rapid cooling rate after annealing or the like. The bainite and martensite degrade machinability of the hot work tool material. Therefore, the structure including less bainite or martensite is preferable according to the present invention.

Accordingly, an annealed structure of the hot work tool material of the present invention preferably has e.g. not less than 80 area % of ferrite grains in the cross-sectional structure. Not less than 90 area % is more preferable. In this regard, carbides of Cr, Mo, W or V etc. within the ferrite grains or at the grain boundaries have less influence on the machinability than pearlite, cementite or the like, and thus they may be included in the area of the ferrite grains.

The hot work tool material having an annealed structure is typically produced from a starting material of a steel ingot or a billet bloomed from the ingot. The starting material is subjected to various hot works or heat treatments followed by annealing, and finished into a block shape. As stated above, a raw material which transforms into a martensite structure by quenching and tempering is conventionally used for the hot work tool material. The martensite structure is necessary for establishing an absolute toughness for various hot work tools. Typical examples of the raw material include various hot work tool steels. The hot work tool steels are used in an environment where a surface temperature of the steels is raised at not lower than about 200° C. Typical compositions of the hot work tool steels include those of standard steel grades in JIS-G-4404 "alloy tool steels" and other proposed materials. In addition, elements that are not defined in the hot work tool steels can be added as necessary.

The effect of suppressing variation of toughness of the present invention can be achieved when the annealed structure satisfies requirement (2) which will be explained later, as far as the annealed structure of the raw material transforms into a martensite structure when quenched and tempered. Accordingly, there is no need to specify a composition of the raw material for achieving the effect of suppressing variation of toughness of the present invention.

However, for establishing the absolute mechanical properties for the hot work tool, the material preferably has a composition of the hot work tool steel including 0.30% to 0.50% of C and 3.00% to 6.00% of Cr by mass, as a composition having a martensite structure. In addition, it is preferable that the hot work tool steel includes 0.10% to 1.50% of V for improving an absolute toughness of the hot work tool. As an example, the material preferably has a composition including 0.30% to 0.50% of C, not greater than 2.00% of Si, not greater than 1.50% of Mn, not greater than 0.0500% of P, not greater than 0.0500% of S, 3.00% to 6.00% of Cr, 0.50% to 3.50% of one or both of Mo and Win an expression of (Mo+½W), 0.10% to 1.50% of V, and the balance of Fe and impurities. When a basic toughness value of the hot work tool is increased, the effect of "suppressing variation of toughness" of the present invention is synergistically effected, so that the hot work tool can have excellent toughness in terms of two aspects of "high toughness" and "stability of toughness".

C: 0.30% to 0.50% by mass (hereinafter, simply expressed as "%")

Carbon is a basic element of the hot work tool material. Carbon partially dissolves in a matrix to provide strength and partially forms carbides to increase a wear resistance or seizure resistance. In addition, when carbon is added together with a substitutional atom having high affinity to carbon, such as Cr, it is expected that the carbon solid-dissolved as an interstitial atom has an I (interstitial atom)-S (substitutional atom) effect (which highly strengthens the hot work tool by acting as a drag resistance of the solute atom). However, excessive addition thereof results in reducing toughness or hot strength. Therefore, the carbon content is preferably 0.30% to 0.50%. It is more preferably not less than 0.34%. It is also more preferably not greater than 0.40%.

Si: not greater than 2.00%

Si is a deoxidizing agent for steel making. Excessive Si causes production of ferrite in the tool structure after quenched and tempered. Therefore, the Si content is preferably not greater than 2.00%. It is more preferably not greater than 1.00%. It is further more preferably not greater than 0.50%. On the other hand, Si has an effect of enhancing a machinability of the material. In order to obtain the effect, addition of not less than 0.20% is preferable. Not less than 0.30% is more preferable.

Mn: not greater than 1.50%

Excessive Mn increases a viscosity of a matrix and reduces a machinability of the material. Therefore, the content is preferably not greater than 1.50%. It is more preferably not greater than 1.00%. It is further more preferably not greater than 0.75%. On the other hand, Mn has effects of enhancing hardenability and suppressing a production of ferrite in the tool structure, thereby obtaining an appropriate quenched and tempered hardness. Furthermore, Mn produces a non-metallic inclusion MnS which has a significant effect in improving machinability. In order to obtain the effects, addition of not less than 0.10% is preferable. Not less than 0.25% is more preferable and not less than 0.45% is further more preferable.

P: not greater than 0.050%

Phosphor is an element that is inevitably included in various hot work tool materials even though it is not intentionally added. It segregates at prior austenite grain boundaries during heat treatment such as tempering, and embrittles the grain boundaries. Accordingly, the phosphor content is preferably limited to not greater than 0.050%, including a case where phosphor is added to improve a toughness of the hot work tool.

S: not greater than 0.0500%

Sulfur is an element that is inevitably included in various hot work tool materials even though it is not intentionally added. It deteriorates a hot workability of raw materials before hot worked and causes cracks in the raw materials during the hot work. Accordingly, the content is preferably limited to not greater than 0.0500% in order to improve the hot workability. On the other hand, sulfur is combined with Mn to form a non-metallic inclusion MnS and has an effect of improving machinability. In order to obtain the effect, addition of not less than 0.0300% is preferable.

Cr: 3.00 to 6.00%

Cr has effects of increasing hardenability and forms a carbide which strengthens a matrix and improves a wear resistance. Furthermore, Cr is a basic element of the hot work tool material, which contributes to improvement of a resistance to temper softening and a high temperature strength. However, excessive addition thereof reduces a hardenability and high-temperature strength. Therefore, the Cr content is preferably 3.00% to 6.00%. It is more preferably not greater than 5.50%. On the other hand, it is preferably not less than 3.50%. Not less than 4.00% is more preferable, and not less than 4.50% is further more preferable.

One or both of Mo and W represented by relational expression of (Mo+½W): 0.50% to 3.50%

Mo and W can be added solely or in combination, in order to precipitate or aggregate fine carbides through tempering to improve strength and resistance to softening. In this regard, the amounts thereof can be defined as an Mo equivalent represented by the relational expression of (Mo+½W) since W has about twice atomic weight of Mo (of course, either one element may be added solely, or both elements can be added in combination). In order to obtain the effects, addition of not less than 0.50% of the Mo equivalent value obtained by the relational expression of (Mo+½W) is preferable. The amount is more preferably not less than 1.50%. It is further more preferably not less than 2.50% However, excessive Mo and W reduces a machinability and toughness, and therefore the content is preferably not greater than 3.50% of the Mo equivalent value obtained by the relational expression of (Mo+½W). It is more preferably not greater than 2.90%.

V: 0.10 to 1.50%

Vanadium forms a carbide and has effects of strengthening a matrix and improving a wear resistance and a resistance to softening in tempering. Furthermore, the vanadium carbide distributed in an annealed structure functions as "pinning particle" which suppresses coarsening of austenite grains during heating for quenching, to contribute to improving toughness. In order to obtain the effects, addition of not less than 0.10% is preferable, not less than 0.30% is more preferable, and not less than 0.50% is further more preferable. However, excessive vanadium reduces a machinability and toughness due to an increase of carbides, and therefore the content is preferably not greater than 1.50%. It is more preferably not greater than 1.00%. It is further more preferably less than 0.70%.

Other than the above elementals, following elementals can be added.

Ni: 0 to 1.00%

Ni is an element that increases a viscosity of a matrix and reduces a machinability. Therefore, the Ni content is preferably not greater than 1.00%. It is more preferably less than 0.50%, further more preferably less than 0.30%. On the other hand, Ni suppresses a production of a ferrite in the tool structure. Furthermore, Ni is effective for excellent hardenability together with C, Cr, Mn, Mo, W, etc., and thus prevents a reduction of a toughness by forming a structure mainly composed of martensite, even though a cooling rate in quenching is low. Furthermore, Ni also improves a basic toughness of a matrix, and therefore may be added as necessary in the present invention. In the case of addition, addition of not less than 0.10% is preferable.

Co: 0 to 1.00%

Co reduces toughness, and thus a Co content is preferably not greater than 1.00%. On the other hand, Co forms a protective dense oxide film which has good adhesion to a surface of the hot work tool at a high temperature in use of the tool. The oxide film prevents a metal contact with a mating member, and suppresses a temperature rise on a tool surface, thereby an excellent wear resistance is obtained. Therefore, Co may be added as necessary. In the case of addition, addition of not less than 0.30% is preferable.

Nb: 0 to 0.30%

Nb reduces a machinability, and thus the Nb content is preferably not greater than 0.30%. Nb has effects of forming a carbide which strengthens a matrix and improves a wear resistance. In addition, Nb has effects of increasing a resistance to temper softening, and suppressing coarsening of grains to contribute to improve a toughness in the same manner as vanadium. Therefore, Nb may be added as necessary. In the case of addition, addition of not less than 0.01% is preferable.

Cu, Al, Ca, Mg, O (oxygen), and N (nitrogen) are elements that may possibly remain in a steel as inevitable impurities. Amounts of these elements are preferably as small as possible in the present invention. However, small amounts may be included in order to obtain additional actions and effects such as improvement of morphology control of inclusions, other mechanically properties, and production efficiency. In this case, ranges of Cu≤0.25%, Al≤0.025%, Ca≤0.0100%, Mg≤0.0100%, O≤0.0100%, and N≤0.0300% are sufficiently permissible and are preferable upper limitations of the present invention.

(2) In the hot work tool material of the present invention, the annealed structure in a cross-section of the hot work tool material comprises ferrite grains, wherein a ratio by number of ferrite grains having a maximum diameter L of not smaller than 100 μm is not more than 10.0% relative to a total number of ferrite grains, and wherein a ration by number of ferrite grains having an aspect ratio L/T of not less than 3.0 is not more than 10.0% relative to the total number of the ferrite grains, where the aspect ratio L/T is defined by a ratio of the maximum diameter L and a maximum transverse width T perpendicular to the maximum diameter L of a grain.

As described above, the hot work tool material having the annealed structure is subject to quenching and tempering. Regarding the quenching and tempering, the quenching is a process in which the material is heated to a quenching temperature (in an austenite temperature range) and is rapidly cooled, thereby a martensite structure is formed from the annealed structure of the material. Specifically, when the temperature has reached a point $A_1$ in a heating process of the material toward the quenching temperature, "new austenite grains" start precipitating preferentially at grain boundaries of ferrite grains in the annealed structure. In a process of holding the material at the quenching temperature after the material has reached the temperature, the annealed structure is totally replaced substantially by the new austenite grains. Then, the material held at the quenching temperature is cooled, thereby the metal structure undergoes martensitic transformation. Thus, a martensite structure is formed where the grain boundaries of the austenite grains are observed as "prior austenite grain boundaries", and thus the quenching is completed. A distribution of "the prior austenite grain size" which is defined by the prior austenite grain boundaries is substantially maintained even after subsequent tempering step is conducted (that is, in the finished hot work tool).

Furthermore, the inventor has studied a relationship between the martensite structure and toughness in a quenched and tempered hot work tool. As a result, he has found that, while an absolute value of the toughness is increased as the prior austenite grain size in the martensite structure is fine, a "variation" of the toughness generates due to a variation of the prior austenite grain size (i.e., a degree of mixed grains is significant) even when the prior austenite grain size is fine. Furthermore, he has found that the variation of the prior austenite grain size (hereinafter, referred to the "mixed grains") results from the fact that, the new austenite grains precipitates at the grain boundaries of the ferrite grains in "a non-uniform distribution" during the quenching process, and the new austenite grains precipitated in a non-uniform distribution grows to "non-uniform sizes" in the quenching process.

Accordingly, it is necessary to precipitate the new austenite grains in a uniform distribution and the precipitated new austenite grains grow to a uniform size in a quenching process, in order to suppress the mixed grains of the prior austenite grains. Furthermore, the inventor has reached, as a result of earnest researches, that the new austenite grains can precipitate and grow "uniformly" when the ferrite grains of the annealed structure of the hot work tool material are "fine" and has "an equiaxial shape" prior to quenching heating. Thai is, in this principle, the ferrite grains in the annealed structure before quenching heating are made "fine" and have "equiaxel manner" so that grain boundaries are uniformly distributed (hereinafter the "precipitation site") where new austenite grains precipitate during the quenching heating. Thereby, the new austenite grains precipitate in a uniform distribution in the quenching process. The uniformly distributed new austenite grains grow to a uniform size. As a result, the new austenite grains are cooled while remaining the uniform size during the material is cooled from the quenching temperature, and thus the prior austenite grains in the quenched martensite structure have also uniform size. Thus, a martensite structure with suppressed mixed grains of prior austenite grains can be obtained.

If the ferrite grains in the annealed structure are coarse, distribution density of the precipitation sites largely differs between the grain boundaries of the ferrite grains and the inside of the grains, and thus the irregular dense distribution of the precipitation sites of the new austenite grains become significant. In addition, if the ferrite grains in the annealed structure do not have the equiaxel shape, but have an acicular shape, the new austenite grains precipitated along the grain boundaries of ferrite grains become "anisotropic". When the hot work tool material having such an annealed structure is quenched, the distribution of the new austenite grains precipitated in the precipitation sites becomes non-uniform, and the precipitated new austenite grains grow to non-uniform sizes. As a result, the prior austenite grain sizes in the quenched martensite structure have non-uniform sizes, thereby the martensite structure has significantly mixed grains of prior austenite grains. Accordingly, it is important to make the ferrite grains of the annealed structure of the material before quenched and tempered have a fine and equiaxel shape in order to suppress the mixed grains of prior austenite grains.

Furthermore, the inventor has conducted further studies on the fine and equiaxel ferrite grains of the annealed structure of the hot work tool material. As a result, the inventor has found that the precipitation sites of the new austenite grains during quenching can be sufficiently made uniform, by reducing "coarse" ferrite grains having a maximum diameter L of not less than 100 μm and "acicular" ferrite grains having an aspect ratio L/T of not less than 3.0 in the cross-sectional annealed structure. Here, the aspect ratio is a ratio of a maximum diameter L in relation to a maximum transverse width T perpendicular to the maximum diameter L. Thus, in the hot work tool material of the present invention, a ratio by number of ferrite grains having a maximum diameter L of not smaller than 100 μm is made not more than 10.0% relative to a total number of ferrite grains, and a ration by number of ferrite grains having an aspect ratio L/T of not less than 3.0 is made not more than 10.0% relative to the total number of the ferrite grains (hereinafter, the ratio by number is represented by "% by number").

When the ratio of the ferrite grains having a maximum diameter L of not smaller than 100 μm is not more than 10.0% by number, the irregular dense distribution of the precipitation sites is eliminated, and the precipitation sites becomes uniform. Not more than 8.0% by number is preferable, and not more than 5.0% by number is more preferable.

When a ration by number of ferrite grains having an aspect ratio L/T of not less than 3.0 is not more than 10.0%, precipitated austenite grains become "isotropic", and the prior austenite grain size after quenching becomes uniform.

Not more than 8.0 by number is preferable, and not more than 7.0 by number is more preferable.

Figure 3A:
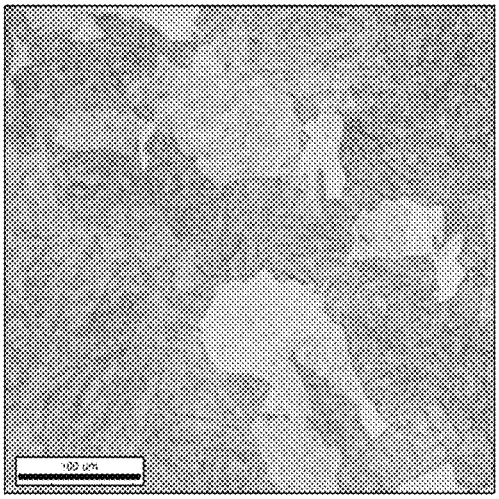
FIGS. 3A and 3B show examples of an optical photomicrograph FIG. 3A and a boundary view FIG. 3B obtained by EBSD of a cross-sectional structure of a hot work tool material A according to an inventive example.
Figure 3B:
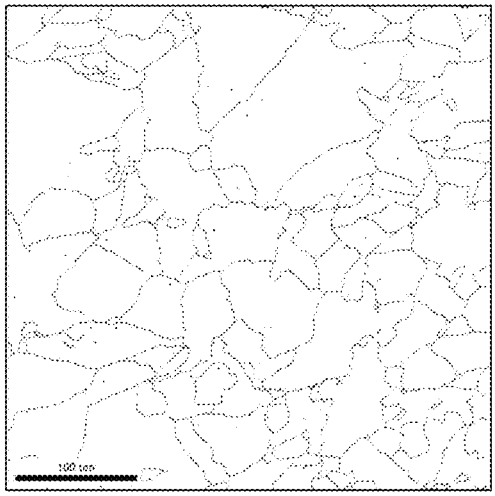
Figure 4A:
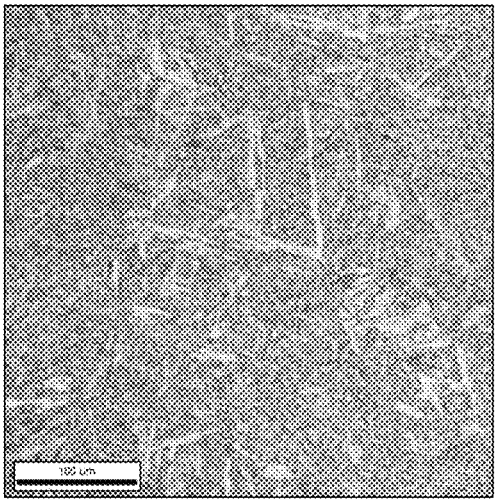
FIGS. 4A and 4B show examples of an optical photomicrograph FIG. 4A and a boundary view FIG. 4B obtained by EBSD of a cross-sectional structure of a hot work tool material F according to an inventive example.
Figure 4B:
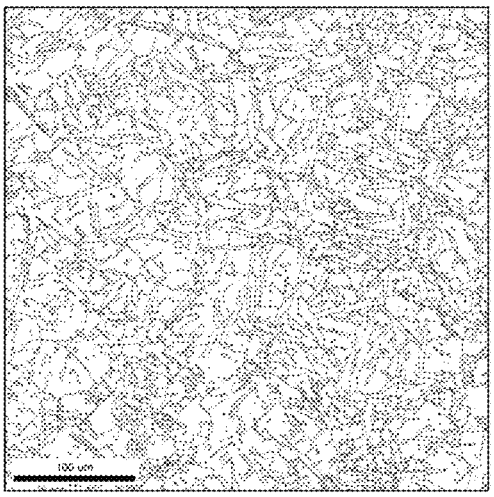

Here, a method of measuring the "maximum diameter L", the "maximum transverse width T" perpendicular to the maximum diameter L, and the "aspect ratio L/T" of the ferrite grains will be described, which are used by the present invention for evaluating the ferrite grains. First, it is necessary to identify individual ferrite grains out of a group of ferrite grains on a cross-section of the hot work tool material by microscopic observation of the sectional structure. For example, EBSD (electron backscatter diffraction analysis) may be used for the identification. EBSD is a method of analyzing an orientation of a crystalline specimen. Individual grains in the cross-sectional structure are identified as a "unit having the same orientation", that is, the grain boundaries can be highlighted. As a result, the group of ferrite grains can be distinguished into individual ferrite grains. FIG. 3B is an example of grain boundary view obtained by the EBSD of the cross-sectional structure of a hot work tool material A, which is evaluated in Example described below. FIG. 3B illustrates a high-angle grain boundary with a misorientation of 15° or more by analyzing the diffraction pattern of the EBSD. In FIG. 3B, each of multiple sections defined by fine lines is a ferrite grain.

Figure 5:
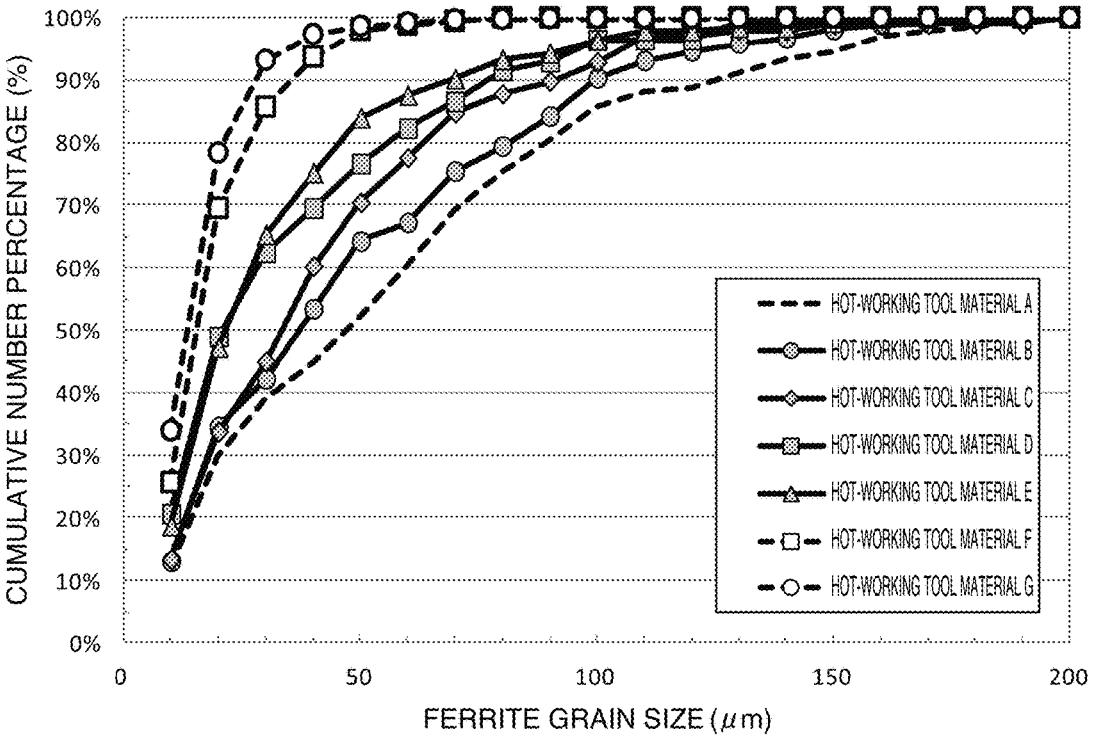
FIG. 5 is a graph indicating an example of a cumulative number ratio of ferrite grains distributed in cross-sectional structures of the hot work tool materials A to G according to inventive examples and comparative examples in relation to a maximum diameter L.
Figure 6:
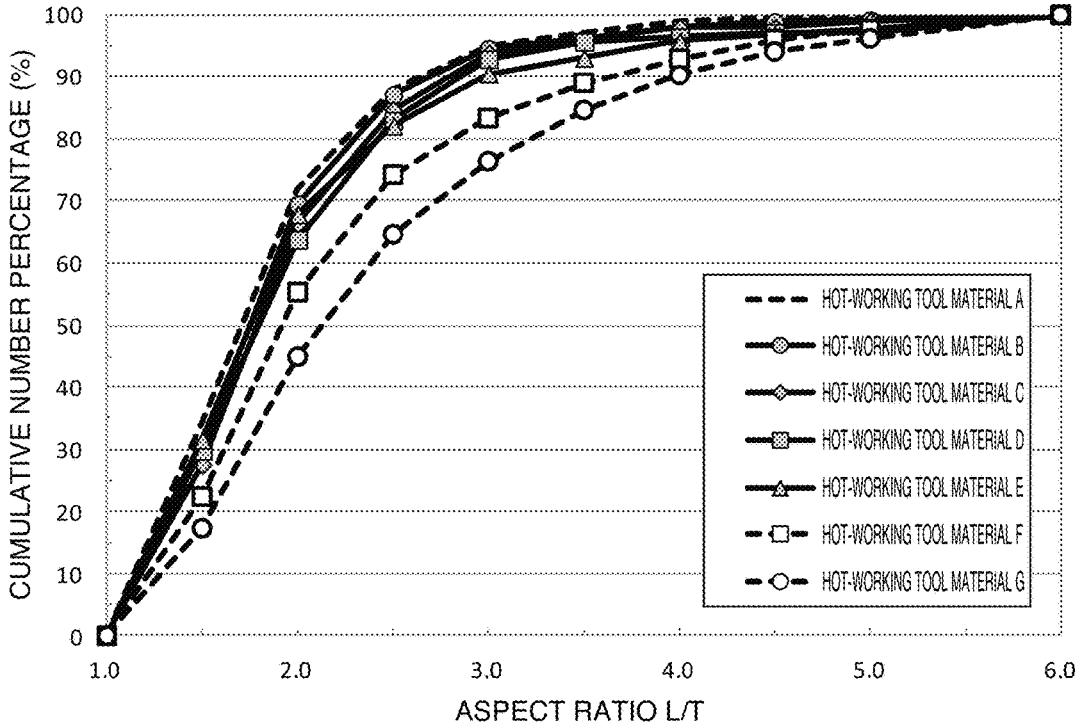
FIG. 6 is a graph indicating an example of a cumulative number ratio of ferrite grains distributed in cross-sectional structures of the hot work tool materials A to G according to inventive examples and comparative examples in relation to an aspect ratio L/T.

Next, the maximum diameter L and the maximum transverse width T perpendicular to the maximum diameter L of the individual ferrite grains, and thus the aspect ratio L/T is determined by means of image analysis software for the ferrite grains obtained in the grain boundary view. At this time, the cross-sectional areas of the individual ferrite grains are determined, and an equivalent circular diameter can be calculated from the cross-sectional areas. Furthermore, a "grain size distribution" in relation to abundance ratios of the maximum diameter L and the aspect ratio L/T is produced using these values. At this time, the abundance ratios are based on a number of ferrite grains within the measured range. The grain size distribution employs an "oversize" cumulative distribution where the minimum value of the maximum diameter L and the aspect ratio L/T is taken as zero. Thus, the produced grain size distribution is represented by a "upward sloping cumulative distribution diagram" where the cumulative number percentage (%) of ferrite grains is plotted on the vertical axis and the maximum diameter L or aspect ratio L/T of ferrite grains is plotted on the horizontal axis. FIG. 5 illustrates an example of an oversize cumulative distribution, that is the cumulative number percentage relative to the maximum diameter L of ferrite grains. In addition, FIG. 6 illustrates an example of an oversize cumulative distribution that is the cumulative number percentage relative to the aspect ratio L/T of ferrite grains. Each point of the polygonal lines in FIGS. 5 and 6 indicates cumulative value "below" a value of its horizontal axis.

After understanding the grain size distributions in relation to the maximum diameter L and the aspect ratio L/T of ferrite grains, when seeing the cumulative number of ferrite grains having a maximum diameter L of less than 100 μm in FIG. 5, the value indicates "the number percentage of ferrite grains having a maximum diameter L of less than 100 μm in relation to the total ferrite grains". In the case of FIG. 5, "the number % of ferrite grains having a maximum diameter L of less than 100 μm" for the boundary view of FIG. 3B is 84.8 number % (for the hot work tool material A). A value obtained by subtracting the value 84.8 number % from 100 number % is "the number % of ferrite grains having a maximum diameter L of not less than 100 μm" defined by the present invention. That is, "the number ratio of ferrite grains having a maximum diameter L of not less than 100 μm" defined by the present invention for the grain boundary view of FIG. 3B is 15.2 number %. When the value is not more than 10.0 number %, it is effective for suppressing the variation of toughness of the quenched and tempered hot work tool according to the present invention.

When seeing the cumulative number of ferrite grains having an aspect ratio L/T of less than 3.0 in FIG. 6, the value indicates "the number % of ferrite grains having an aspect ratio L/T of less than 3.0 in relation to the total ferrite grains". In the case of FIG. 6, "the number % of ferrite grains having an aspect ratio L/T of less than 3.0" in the grain boundary view of FIG. FIG. 3B is 95.1 number % (for the hot work tool material A). A value obtained by subtracting the value 95.1 number % from 100 number % is "the number % of ferrite grains having an aspect ratio L/T of not less than 3.0" defined by the present invention. That is, "the number % of ferrite grains having an aspect ratio L/T of not less than 3.0" defined by the present invention for the grain boundary view of FIG. 3B is 4.9 number %. In the case where the value is not more than 10.0 number %, it is effective for suppressing the variation of toughness of the quenched and tempered hot work tool according to the present invention.

In the hot work tool material according to the present invention, the ferrite grains in the annealed structure in the cross-section of the material preferably have an average grain size of not greater than 25.0 μm in equivalent circular diameter. Ferrite grains having a smaller average grain size are more advantageous for homogenization of the precipitation sites. In addition, since the ferrite grains have a small average grain size, the prior austenite grains in the quenched and tempered structure can be made fine to improve the toughness of the hot work tool as a whole. The prior austenite grains in the cross-sectional structure of a hot work tool preferably has a grain size number No. 8.0 or more according to JIS-G-0551 (the prior austenite grain size is smaller as the grain size number increases), more preferably No. 8.5 or more, and further more preferably No. 9.0 or more. Please note that the grain size number according to JIS-G-0551 is equivalent to that according to international standard ASTM-E112.

The measurement of the "prior austenite grains in the quenched and tempered structure" can be conducted using the quenched structure before tempered. This is because the quenched structure does not include fine carbides precipitated by tempering, it is easy to determine the prior austenite grains. Furthermore, the grain sizes of the prior austenite grains after quenched are retained even after tempered. The same applies to the case of measuring "mixed grains of prior austenite grains in the quenched and tempered structure" to be described below.

The hot work tool material having the annealed structure is typically produced from a starting material of a steel ingot or a bloom which is bloomed from a steel ingot, which starting material is then subjected to various hot processing or heat treatment, and then subjected to annealing. The steel material before annealed has, for example, a martensite structure, in which a bainite structure inevitably remains. If the steel material is annealed inappropriately, ferrite grains are incompletely generated. In the case, acicular ferrite grains are generated in trace parts of the bainite structure. In addition, inappropriate annealing results in excessive growth to generate coarse ferrite grains. Therefore, it is important to properly control the annealing process of the steel material to achieve the annealed structure of the hot work tool material of the present invention.

For example, adjustment of "a retention temperature" during the annealing of the steel material is important. By limiting the retention temperature (e.g., less than 870° C.), coarsening of ferrite grains can be suppressed. Furthermore, for example, adjustment of "retention time" from a time when the steel material reaches the retention temperature is important. A sufficient annealing retention time (e.g., 180 minutes or longer) enables suppression of acicular ferrite grains. Furthermore, by limiting the retention time (e.g., 400 minutes or shorter), coarsening of ferrite grains can be suppressed.

As described above, it is preferable that bainite or martensite is not formed in the annealed structure to achieve machining properties of the hot work tool material. It is effective to control a cooling rate from the retention temperature so that it is not excessively rapidly cooled in order to suppress the formation of bainite or martensite in the annealing.

Furthermore, it is preferable to control the cooling rate from the annealing temperature to 600° C. at a low cooling rate of "not higher than 20° C./hour" in order to suppress the formation of the bainite or martensite so that an area ratio of ferrite grains in the cross-sectional structure of the hot work tool material is increased to, for example, "not less than 80 area %".

(3) A method for manufacturing a hot work tool according to the present invention includes quenching and tempering the above hot work tool material.

The mixed grains of prior austenite grains in the martensite structure can be suppressed by quenching the hot work tool material of the present invention. The degree of the mixed grains is substantially maintained after subsequently tempered. Thus, the variation of toughness of the hot work tool can be suppressed by quenching and tempering the material. Regarding the degree of variations of toughness, an average Charpy impact value has a standard deviation of not more than 5.00 (J/cm$^2$), for example. Furthermore, a standard deviation of not more than 4.00 (J/cm$^2$) can be also achieved.

Regarding the words "mixed grains of prior austenite grains", the "mixed grains" is defined in JIS-G-0551 such that "there are unevenly distributed grains whose grain size number roughly differs by three or more from a most frequent grain number in one visual field, and the unevenly distributed grains have an area ratio of about not less than 20%. Alternatively, there are visual fields having grain size numbers which differ by three or more with each other".

With regard to the definition of the mixed grains, the present invention can achieve that an area ratio of prior austenite grains having a grain size number different by three or more from a most frequent grain size number of the prior austenite grains is not greater than 5 area %". Preferably, the area ratio is not greater than 4 area %, more preferably not greater than 3 area %.

Herein, the "grain size number" of a cross-sectional structure is measured on the entire cross-sectional structure. The "grains of grain size number G" herein indicates "individual grains" having a cross-sectional area that corresponds to "the calculated average cross-sectional area of grains" of the grain size number G The "calculated average cross-sectional area of grains" is calculated from "calculated number "m" of grains per cross-sectional area of 1 mm$^2$" determined by the calculation formula: $8\times2^G$. For example, the cross-sectional area of "grains of grain size number 8.0" corresponds to "0.000488 mm$^2$" (m=2048/mm$^2$), and the cross-sectional area of "grains of grain size number 9.0" corresponds to "0.000244 mm$^2$" (m=4096/mm$^2$).

According to the present invention, the cross-sectional area of the cross-sectional structure for measuring "percentage of prior austenite grains" is set to be "0.16 mm$^2$ (400 μm×400 μm)". One visual field is set to have this cross-sectional area, and it is sufficient to observe 10 visual fields.

Furthermore, the present invention achieves that each two fields of view do not have the prior austenite grain size numbers in accordance with JIS-G-0551 different from each other by three or more. Preferably, each two fields of view do not have the prior austenite grain size numbers different from each other by two or more.

In this case, it is sufficient to observe ten visual fields to confirm it, provided that one visual field has an area of "0.16 mm$^2$ (400 μm×400 μm)".

From the above, the present invention can eliminate the "variation in prior austenite grain size" remaining in the structure, even when the hot work tool is regarded as not including mixed grains according to the definition of JIS-G-0551. Thus, the variation of toughness of the hot work tool can be further suppressed. Furthermore, refinement of prior austenite grains can be achieved, that is, the hot work tool preferably has a grain size number of No. 8.0 or more. Thus, the toughness of the hot work tool is also improved as a whole.

The hot work tool material of the present invention is quenched and tempered to have a martensite structure to adjust a predetermined hardness and then is finished into a hot work tool product. In this process, the hot work tool material is subject to various machining such as cutting and punching to give a shape of the hot work tool. Machining is preferably conducted before quenched and tempered since the material has a low hardness (i.e., in an annealed state). Finishing processing can be conducted after quenched and tempered. In some cases, the above machining may be carried out in a pre-hardened state after quenched and tempered in combination with the finishing processing.

Temperatures of quenching and tempering vary depending on compositions of the material or a target hardness or the like. However, the quenching temperature is preferably around 1000 to 1100° C. and the tempering temperature is preferably around 500 to 650° C. For example, in the case of SKD61 which is a typical steel grade of the hot work tool steel, the quenching temperature is about 1000 to 1030° C. and the tempering temperature is about 550 to 650° C. Quenching and tempering hardness is preferably not greater than 50 HRC, more preferably not greater than 48 HRC.

EXAMPLE

Raw materials A to G (50 mm thickness×50 mm width×100 mm length) having compositions in Table 1 were prepared. Notes that the raw materials A to G are modified steels of a hot work tool steel SKD61 which is a steel grade specified in JIS-G-4404. Next, the raw materials were heated at 1100° C., which is a typical hot work temperature for a hot work tool steel, and then hot-worked, and then allowed to cool. The hot-worked and cooled steel materials were annealed at 860° C., thereby hot work tool materials A to G were produced corresponding to the raw materials A to G respectively. For the annealing, annealing retention times from reaching the annealing temperature of 860° C. are set as follow:

material A: 540 minutes,
material B: 400 minutes,
material C: 300 minutes,
material D: 240 minutes,
material E: 180 minutes,
material F: 100 minutes, and
material G: 30 minutes.

All the hot work tool materials were cooled until reaching 600° C. at a cooling rate 20° C./hour. Separately, a material C was also cooled at a cooling rate 120° C./hour as well as at a cooling rate 20° C./hour. The material cooled at a cooling rate 120° C./hour is referred to "material H".

TABLE 1

| mass % | | | | | | | | |
|---|---|---|---|---|---|---|---|---|
| C | Si | Mn | P | S | Cr | Mo | V | Fe※ |
| 0.37 | 0.38 | 0.70 | 0.010 | 0.0040 | 5.16 | 2.66 | 0.64 | Bal. |

※INCLUDING IMPURITIES

Cross-sectional structures of the annealed materials A to H were observed. The observed cross-sections were taken from a central part of the materials in a plane parallel to the working direction (i.e., the longitudinal direction of the materials). The observation was carried out with an optical microscope (200 times magnification). The observed cross-sectional area was 0.16 $mm^2$ (400 μm×400 μm). As a result, the cross-sectional structures of the hot work tool materials A to G were almost entirely composed of ferrite phase. The ferrite grains occupied 99 area % or more of the observed cross-sections. In contrast, no ferrite phase was practically observed in the cross-sectional structure of the material H, and 95 area % or more of the observed cross-section was composed of bainite and martensite. Furthermore, the material H was inferior in machining properties, and was difficult to apply to a hot work tool as it is.

Next, the distributions of ferrite grains in the cross-sectional structures of the materials A to G were observed. EBSD patterns with a magnification of 200 times in cross-sectional structures of 0.16 $mm^2$ were analyzed, and grain boundary views in which grains were separated by high-angle grain boundaries having a misorientation of 15 degrees or more were obtained. An EBSD device (measurement interval: 0.5 μm) attached to a scanning electron microscope (Carl Zeiss ULTRA 55) was used for the analysis of the EBSD patterns. For examples, the grain boundary views of the materials A, D, E, and F are illustrated in FIGS. 3B, 1B, 2B, and 4B respectively. FIGS. 1A, 2A, 3A, and 4A also illustrate optical photomicrographs of the cross-sectional structures (magnification is 200 times). Maximum diameters L and aspect ratios L/T as well as equivalent circular diameters were determined from the grain boundary views for individual ferrite grains. Furthermore, obtained were the grain size distributions of the ferrite grains in relation to the maximum diameter L and the aspect ratio L/T.

FIG. 5 shows cumulative number percentages in relation to the maximum diameter L of ferrite grains of the materials A to G. In FIG. 5, the vertical axis is the cumulative number (%) of ferrite grains and the horizontal axis is the maximum diameter L of ferrite grains. In addition, FIG. 6 shows the cumulative number percentages in relation to the aspect ratio L/T of ferrite grains. In FIG. 6, the vertical axis is the cumulative number (%) of ferrite grains and the horizontal axis is the aspect ratio L/T of ferrite grains. According to the results of FIGS. 5 and 6, "a ratio by number of ferrite grains having a maximum diameter L of not smaller than 100 μm" and "a ration by number of ferrite grains having an aspect ratio L/T of not less than 3.0" in the cross-sections of the structures of the materials A to G are described in Table 2. Table 2 also indicates the average ferrite grain sizes of by equivalent circular diameter.

TABLE 2

| MATERIAL | Ratio by NUMBER % OF FERRITE GRAINS L ≥ 100 μm | L/T ≥ 3.0 | AVERAGE FERRITE GRAIN SIZE (μm) | REMARK |
|---|---|---|---|---|
| A | 15.2 | 4.9 | 34.8 | COMPARATIVE EXAMPLE |
| B | 9.7 | 5.4 | 29.1 | INVENTIVE |
| C | 7.1 | 6.1 | 25.0 | EXAMPLE |
| D | 3.5 | 7.1 | 20.6 | |
| E | 3.6 | 9.5 | 19.4 | |
| F | 1.0 | 16.7 | 10.4 | COMPARATIVE |
| G | 0.1 | 23.6 | 9.7 | EXAMPLE |

After the observation, the hot work tool materials A to G were quenched from 1030° C. and tempering at 630° C. (target hardness 45 HRC). Thus, the hot work tools A to G having a martensite structure were obtained, which correspond to the hot work tool materials A to G respectively. 10 test pieces for Charpy impact test (T direction, 2 mm U-notch) were taken from portions including the cross-sectional structures where the grain size distributions of ferrite grains were observed, for each of the hot work tools A to G, and Charpy impact tests were conducted. An average value and a standard deviation were determined from the 10 Charpy impact values to evaluate a degree of variation of toughness. In addition, grain sizes of the prior austenite grains in the structures were measured for the 10 Charpy impact test pieces to determine grain size numbers according to JIS-G-0551. The grain size numbers were averaged and were rounded off in 0.5 units. Then, the presence or absence of mixed grains based on the criteria of the present invention (i.e., (1) the presence or absence and the area ratio of prior austenite grains whose grain size numbers differ by three or more from the grain the most frequent size number of prior austenite grains, and (2) the presence or absence of visual fields which have different grain size numbers of prior austenite grains by three or more therebetween) was studied. Table 3 shows the results.

TABLE 3

| | CHARPY IMPACT VALUE (J/$cm^2$) | | PRIOR AUSTENITE CRYSTAL GRAIN | | | |
|---|---|---|---|---|---|---|
| | | | GRAIN SIZE | PRESENCE OR ABSENCE OF MIXED GRAIN | | |
| MATERIAL | AVERAGE VALUE | STANDARD DEVIATION | NUMBER | (1) | (2) | REMARK |
| A | 51.4 | 5.21 | 8.0 | YES (8 area %) | NO | COMPARATIVE EXAMPLE |
| B | 54.0 | 2.99 | 8.0 | NO | NO | INVENTIVE |
| C | 55.8 | 3.61 | 8.5 | NO | NO | EXAMPLE |

TABLE 3-continued

| | CHARPY IMPACT VALUE ($J/cm^2$) | | PRIOR AUSTENITE CRYSTAL GRAIN | | | |
|---|---|---|---|---|---|---|
| | | | GRAIN SIZE | PRESENCE OR ABSENCE OF MIXED GRAIN | | |
| MATERIAL | AVERAGE VALUE | STANDARD DEVIATION | NUMBER | (1) | (2) | REMARK |
| D | 55.0 | 2.90 | 8.5 | NO | NO | |
| E | 54.3 | 3.60 | 9.0 | NO | NO | |
| F | 53.3 | 5.41 | 8.5 | YES (8 area %) | NO | COMPARATIVE EXAMPLE |
| G | 53.3 | 6.09 | 9.0 | YES (8 area %) | NO | |

According to Table 3, all hot work tools achieved a high average Charpy impact value, and had a high toughness as a whole. Among the hot work tools, particularly tools C, D and E have higher average Charpy impact values along with the fact that the average grain sizes of ferrite grains of the hot work tool materials before quenched and tempered were small. The hot work tools B to E which were obtained by quenching and tempering the hot work tool materials of the present invention have standard deviations of 5.00 ($J/cm^2$) or less with respect to the average Charpy impact value, thus the variations of toughness are suppressed.

In 10 Charpy impact test pieces of the hot work tools B to E according to the inventive examples, no prior austenite grains size numbers differ by three or more from the most frequent grain size number (i.e., the grain size number indicated in Table 3). In addition, among the visual fields, no visual fields have the grain size numbers of prior austenite grains differ by three or more between the fields. Thus, mixed grains based on the criteria of the present invention did not occur. Furthermore, the hot work tools B to E according to the inventive examples have the grain size numbers of prior austenite grains of No. 8.0 or more. In particular, the hot work tools C, D and E have the grain size numbers of prior austenite grains of No. 8.5 or more since the average grain sizes of ferrite grains were small in the state of a hot work tool material.

In contrast, the hot work tools A, F and G of the comparative examples also have the grain size numbers of prior austenite grains of No. 8.0 or more. In addition, no visual fields have the grain size numbers of prior austenite grains differ by three or more between the fields. In the structures of the hot work tools A, F and G, however, there were prior austenite grains having large grain sizes whose grain size numbers were smaller by three or more than the most frequent grain size numbers (i.e., the grain size numbers described in Table 3). Furthermore, the area ratios of the prior austenite grains whose grain size numbers were smaller by three or more were about 8 area %. Thus, mixed grains were observed on the basis of the criteria of the present invention.

The invention claimed is:

1. A hot work tool material having an annealed structure, the hot work tool material subjected to quenching and tempering before use, the hot work tool material having a composition consisting of, by mass:

C: 0.30% to 0.50%,
Si: not more than 2.00%,
Mn: not more than 1.50%,
P: not more than 0.050%,
S: not more than 0.0500%,
Cr: 3.00% to 6.00%,
one or both of Mo and W in an expression of (Mo+½W): 0.50% to 3.50%,
V: 0.10% to 1.50%,
Ni: 0 to 1.00%,
Co: 0 to 1.00%,
Nb: 0 to 0.30%, and
the balance being Fe and impurities, the annealed structure in a cross-section of the hot work tool material comprising ferrite grains, wherein a ratio by number of ferrite grains having a maximum diameter L of not smaller than 100 μm is not more than 10.0% relative to a total number of the ferrite grains, and wherein a ratio by number of ferrite grains having an aspect ratio L/T of not less than 3.0 is not more than 10.0% relative to the total number of the ferrite grains, where the aspect ratio L/T is defined by a ratio of the maximum diameter L and a maximum transverse width T perpendicular to the maximum diameter L of a grain.

2. The hot work tool material according to claim 1, wherein the ferrite grains in the annealed structure in the cross-section of the hot work tool material have an average grain size of not greater than 25.0 μm in equivalent circular diameter.

3. A method for manufacturing a hot work tool, comprising quenching and tempering the hot work tool material according to claim 1.

4. The method according to claim 3, wherein an area ratio of prior austenite grains having a grain size number in accordance with JIS-G-0551 different by three or more from a most frequent grain size number of the prior austenite grains is not greater than 5 area %.

5. The method according to claim 4, wherein a field of view in a cross-section of a hot work tool manufactured by the method is a 400 μm×400 μm area in the cross-section of the hot work tool, and when ten fields of view are observed in the cross-section of the hot work tool, any two fields of view do not have the prior austenite grain size numbers in accordance with JIS-G-0551 different from each other by three or more.

* * * * *